US009186920B2

(12) United States Patent
Kikura et al.

(10) Patent No.: US 9,186,920 B2
(45) Date of Patent: Nov. 17, 2015

(54) IMAGE FORMING APPARATUS WITH MEDIUM HOLDING DEVICES RETRACTABLE TO ACCESS TRANSPORT PATH

(71) Applicants: Makoto Kikura, Kanagawa (JP); Kazuyoshi Matsumoto, Tokyo (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP)

(72) Inventors: Makoto Kikura, Kanagawa (JP); Kazuyoshi Matsumoto, Tokyo (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/011,942

(22) Filed: Aug. 28, 2013

(65) Prior Publication Data

US 2014/0099149 A1 Apr. 10, 2014

(30) Foreign Application Priority Data

Oct. 6, 2012 (JP) ..... 2012-223714

(51) Int. Cl.

| | |
|---|---|
| ***B41J 15/04*** | (2006.01) |
| ***B41J 29/13*** | (2006.01) |
| ***B41J 29/02*** | (2006.01) |
| ***B41J 3/407*** | (2006.01) |
| ***B41J 11/00*** | (2006.01) |

(52) U.S. Cl.

CPC ..... *B41J 15/046* (2013.01); *B41J 3/4075* (2013.01); *B41J 11/006* (2013.01); *B41J 11/007* (2013.01); *B41J 29/02* (2013.01); *B41J 29/13* (2013.01)

(58) Field of Classification Search

CPC ..... B41J 29/13; B41J 11/006; B41J 29/02; B41J 15/048; B41J 15/08; B41J 15/14; B41J 11/0045; B41J 15/046; G03G 15/6517; G03G 15/652; G03G 15/6526

IPC ..... B41J 11/0045, 11/006, 11/007, 29/02, B41J 29/13, 15/046

See application file for complete search history.

(56) References Cited

U.S. PATENT DOCUMENTS 4,857,943 A * 8/1989 Yoshimura et al. ..... 346/136

(Continued)

FOREIGN PATENT DOCUMENTS

| | | | | |
|---|---|---|---|---|
| JP | 61-178826 | | 8/1986 | |
| JP | 01145176 A | * | 6/1989 | ..... B41J 17/18 |
| JP | 05204198 A | * | 8/1993 | ..... G03G 15/00 |
| JP | 08169580 A | * | 7/1996 | ..... B65H 3/44 |
| JP | 2001033928 A | * | 2/2001 | ..... G03D 13/00 |

(Continued)

*Primary Examiner* — Daniel J Colilla

(74) *Attorney, Agent, or Firm* — Cooper & Dunham LLP

(57) ABSTRACT

An image forming apparatus includes, an image forming device, a transporting device, a first medium holding device, and a second medium holding device. The image forming device forms an image on a print medium unwound from a roll. The transporting device is configured to transport the unwound print medium on a transport path facing the image forming device. The first medium holding device is disposed upstream of the image forming device in a medium transporting direction, and configured to hold the print medium on the transport path and retract to an open position for opening the transport path. The second medium holding device is disposed downstream of the image forming device in the medium transporting direction, and configured to hold the print medium on the transport path and retract to an open position for opening the transport path.

12 Claims, 5 Drawing Sheets

(56) References Cited

U.S. PATENT DOCUMENTS

| | | | | |
|---|---|---|---|---|
| 4,893,137 | A * | 1/1990 | Ebinuma et al. | 346/134 |
| 2004/0134958 | A1* | 7/2004 | Burdenko | 226/186 |
| 2010/0182371 | A1* | 7/2010 | Tomoguchi | 347/32 |
| 2014/0139085 | A1* | 5/2014 | Sasaki | 312/324 |

FOREIGN PATENT DOCUMENTS

| | | | |
|---|---|---|---|
| JP | 2005-081729 | | 3/2005 |
| JP | 2006-008297 | | 1/2006 |
| JP | 2009-214975 | | 9/2009 |
| JP | 2012136034 | A * | 7/2012 |

* cited by examiner

IMAGE FORMING APPARATUS WITH MEDIUM HOLDING DEVICES RETRACTABLE TO ACCESS TRANSPORT PATH

CROSS-REFERENCE TO RELATED APPLICATION

This patent application is based on and claims priority pursuant to 35 U.S.C. §119 to Japanese Patent Application No. 2012-223714, filed on Oct. 6, 2012, in the Japan Patent Office, the entire disclosure of which is hereby incorporated by reference herein.

BACKGROUND

1. Technical Field

The present invention relates to an image forming apparatus, particularly to an image forming apparatus using a rolled print medium.

2. Related Art

An image forming apparatus, such as a label printer, performs printing on a print medium having an adhesive surface with no release liner attached thereto, such as an adhesive tape or a label sheet with no backing sheet, (hereinafter also referred to as a linerless label sheet), and thereafter cuts the print medium into print medium pieces (hereinafter also referred to as label pieces) of a desired length.

A printer that performs printing on labels temporarily attached to a label continuum may include, for example, a label holding device that suppresses flapping of the label continuum fed from a storage space storing the label continuum to a printing position by holding the label continuum between the label holding device and a guide plate. The label holding device includes an upper cover for opening and closing an upper part of the storage space and a label holder attached to the upper cover. When the upper cover closes, the label holder moves to a position at which the label holder and the guide plate hold therebetween the label continuum. When the upper cover opens, the label holder moves upward with the upper cover.

In general, a print medium such as a linerless label sheet is unwound from a roll and set on a transporting device. Since no release liner is attached to the adhesive surface of the print medium, the print medium is peeled off from the roll. Such peeling of the print medium causes a leading end portion of the print medium to curl in the opposite direction to the winding direction of the roll. When the print medium with such a relatively large curl is set on the transporting device, it is desirable to perform the setting of the print medium while removing the curl, and simplify the operation of setting the print medium.

The above-described label holding device is capable of holding the print medium. However, the label holder moves with the opening or closing movement of the upper cover. When the upper cover is closed, therefore, the print medium is not visible, and thus whether or not the print medium is correctly set is not ascertainable. Further, the setting of the print medium involves opening and closing the entire upper cover, which affects operability.

SUMMARY

It is an object of the present invention to improve the operability of the operation of setting a rolled print medium. The present invention provides an improved image forming apparatus that, in one example, includes an image forming device, a transporting device, a first medium holding device, and a second medium holding device. The image forming device is configured to form an image on a print medium unwound from a roll. The transporting device is configured to transport the unwound print medium on a transport path facing the image forming device. The first medium holding device is disposed upstream of the image forming device in a medium transporting direction, and configured to hold the print medium on the transport path and retract to an open position for opening the transport path. The second medium holding device is disposed downstream of the image forming device in the medium transporting direction, and configured to hold the print medium on the transport path and retract to an open position for opening the transport path.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
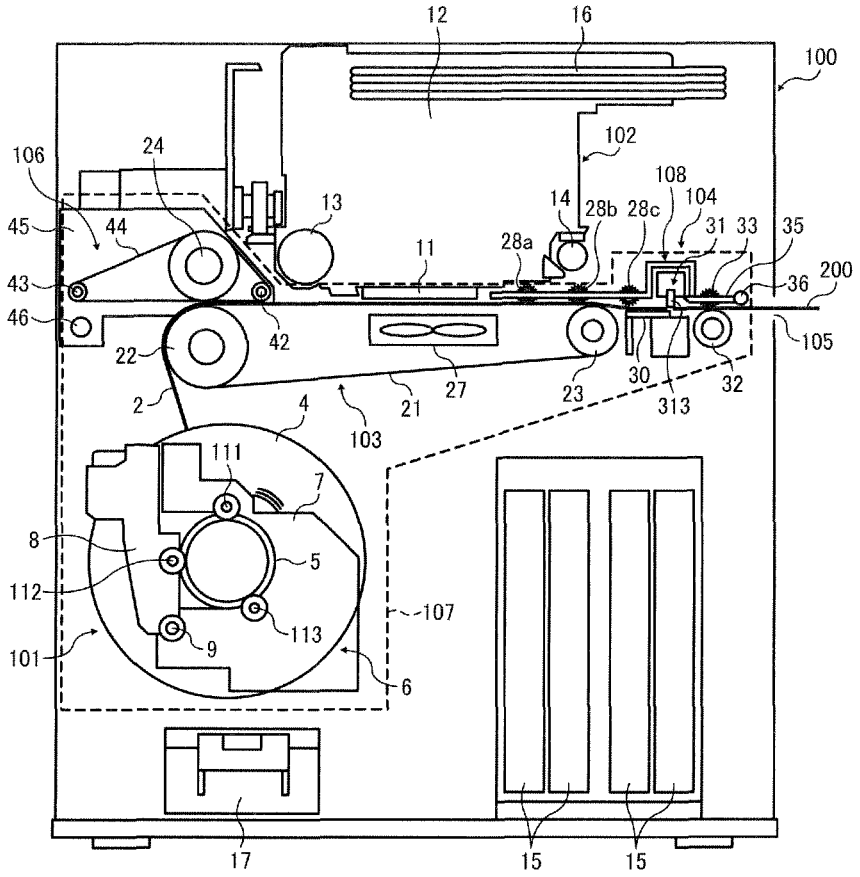
FIG. 1 is a front view of a mechanical section of an image forming apparatus according to a first embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

Figure 2:
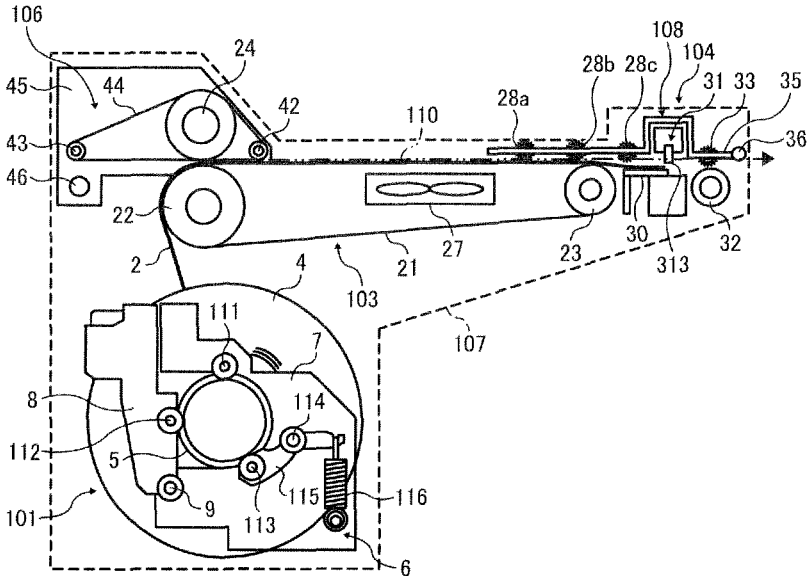
FIG. 2 is a front view of a sheet feeding and transporting unit of the mechanical section.
Figure 3:
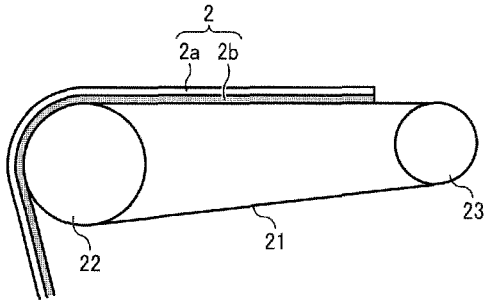
FIG. 3 is a front view of related parts of the sheet feeding and transporting unit transporting a print medium.

With reference to FIGS. 1 to 3, an image forming apparatus according to a first embodiment of the present invention will be described. FIG. 1 is a front view of a mechanical section of the image forming apparatus. FIG. 2 is a front view of a sheet feeding and transporting unit of the mechanical section. FIG. 3 is a front view of related parts of the sheet feeding and transporting unit transporting a print medium.

Figure 4:
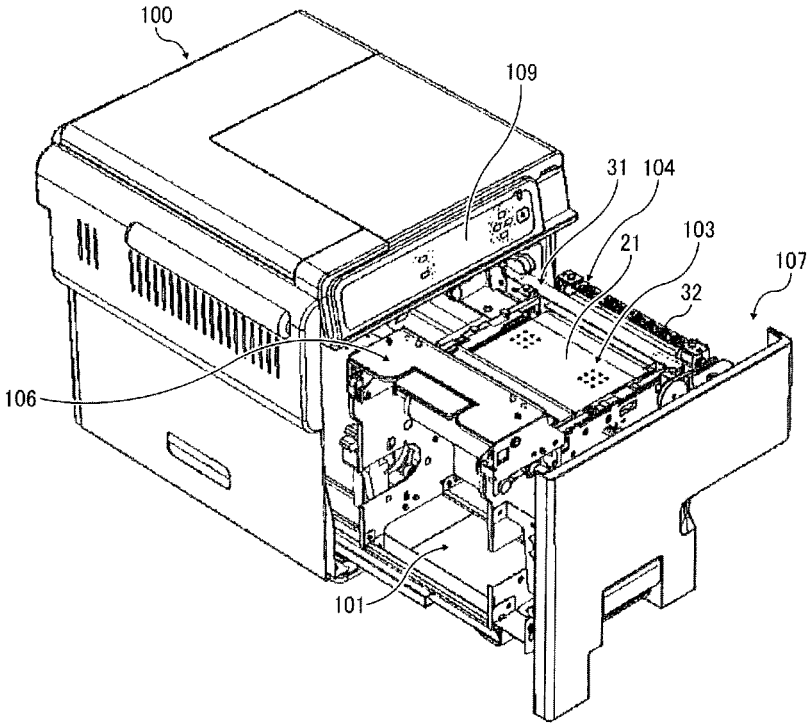
FIG. 4 is a perspective view of the sheet feeding and transporting unit drawn from the body of the image forming apparatus to set therein the print medium.

The image forming apparatus includes an apparatus body 100 including a sheet feeding unit 101 (i.e., a sheet feeding device), an image forming unit 102 (i.e., an image forming device), a transporting unit 103 (i.e., a transporting device), a sheet discharging unit 104 (i.e., a sheet discharging device), a guiding device 106 (i.e., a first medium holding device), a second medium holding device 108, ink cartridges 15, a waste liquid tank 17, a discharge opening 105, and an operation panel 109, as shown in FIG. 4. The sheet feeding unit 101, the transporting unit 103, the sheet discharging unit 104, the guiding device 106, and the second medium holding device 108 are integrated as a sheet feeding and transporting unit 107 drawable from the apparatus body 100. The guiding device 106 guides a print medium 2 (also referred to as a recording medium or a sheet, for example) during transport or rewinding of the print medium 2.

The print medium 2 is wound in a roll 4, which is installed in the sheet feeding unit 101. As illustrated in FIG. 3, in the present embodiment, the print medium 2 is a continuum of an image-formable medium having a surface formed with an adhesive layer. Hereinafter, the image-formable medium and the adhesive layer will be referred to as the printing surface 2*a* and the adhesive surface 2*b*, respectively. Specifically, the print medium 2 is a rolled linerless label sheet with no backing sheet (i.e., release liner or separator) attached to the adhesive surface 2*b*.

The sheet feeding unit 101 includes the roll 4, a spool 5, and two roll holders 6. The drawings illustrate one of the two roll holders 6, i.e., the roll holder 6 on the front side of the apparatus body 100. As illustrated in FIG. 2, each of the roll holders 6 includes a spool bearing 7, an opening and closing member 8, a first roller 111, a second roller 112, a third roller 113 (i.e., first to third rotary members), a shaft 9, a shaft 114, a roller holder 115, and a spring 116.

The roll 4 is fitted around the spool 5. The spool 5 has opposed end portions each rotatably held at three points by the first roller 111, the second roller 112, and the third roller 113 of the corresponding roll holder 6. The first roller 111 is rotatably held by the spool bearing 7, in which the corresponding end portion of the spool 5 is fitted. The second roller 112 is rotatably held by the opening and closing member 8 configured to rotate about the shaft 9 to open and close relative to the spool bearing 7. The third roller 113 is rotatably held by the roller holder 115, which is rotatably held by the shaft 114 and biased by the spring 116 in a direction of pressing the third roller 113 against the spool 5.

The image forming unit 102 includes a carriage 12, two recording heads 11, a main guide member 13, a sub-guide member 14, and supply tubes 16. The recording heads 11, which are liquid ejection heads that eject liquid droplets onto the print medium 2, are mounted on the carriage 12. The carriage 12 is movably held by the main guide member 13 and the sub-guide member 14 to move from side to side in a main scanning direction substantially perpendicular to the direction of transporting the print medium 2 (hereinafter referred to as the medium transporting direction).

The present embodiment uses, as the recording heads 11, two liquid ejection heads each including two nozzle rows (not illustrated) to eject ink droplets of black, cyan, magenta, and yellow colors from four nozzle rows. The recording heads 11, however, are not limited thereto, and may be line heads. Inks of the respective colors are supplied as necessary from the ink cartridges 15 replaceably installed in the apparatus body 100 to head tanks (not illustrated) of the carriage 12 through the supply tubes 16, and then to the recording heads 11. Waste ink resulting from, for example, a maintenance operation for maintaining and restoring the performance of the recording heads 11 is discharged to and stored in the waste liquid tank 17 replaceably installed in the apparatus body 100. In the image forming unit 102, the form of the recording heads 11 (i.e., liquid ejection heads) are not limited, as described above. Further, various types of image forming devices that form an image on a print medium in a contact or non-contact manner are applicable to the image forming unit 102.

The transporting unit 103 includes an endless protection belt 21, a transport roller 22, a driven roller 23, a facing roller 24, and a suction fan 27. As illustrated in FIG. 2, a transport path 110 extends from the transporting unit 103 to the sheet discharging unit 104. The protection belt 21 serving as a transport belt is disposed below the recording heads 11, and is rotatably stretched taut around the transport roller 22 and the driven roller 23. Preferably, the protection belt 21 is not adhesive to the adhesive surface 2*b* of the print medium 2. The protection belt 21, however, may have weak adhesiveness to the adhesive surface 2*b* of the print medium 2 to prevent the print medium 2 from separating from the protection belt 21 during the transport of the print medium 2 (hereinafter referred to as the medium transporting operation) and separate from the print medium 2 after the medium transporting operation. Received by the protection belt 21, the adhesive surface 2*b* of the print medium 2 is protected and prevented from coming into contact with other components inside the apparatus body 100. Thereby, stable transport performance is obtained. Further, due to the separability of the protection belt 21 from the adhesive surface 2*b* of the print medium 2, the print medium 2 is reliably sent to the next process. That is, the protection belt 21 of the present embodiment functions as a transport belt and also as a protector of the adhesive surface 2*b* of the print medium 2.

The facing roller 24 is disposed facing the transport roller 22. The transport roller 22 and the facing roller 24 form a transport roller pair (i.e., a rotary member pair) serving as a transporting device that clamps and transports the print medium 2 and the protection belt 21 to an image forming area in which an image is formed by the recording heads 11. The protection belt 21 is formed with a multitude of suction holes. Inside a loop of the protection belt 21, the suction fan 27 is disposed facing the recording heads 11 of the image forming unit 102 via the protection belt 21. The suction fan 27 sucks the print medium 2 toward the outer circumferential surface of the protection belt 21 through the suction holes.

It is to he noted that the transporting unit 103 of the present embodiment is configured to attract the print medium 2 toward the protection belt 21 by suction. However, the configuration is not limited thereto. For example, the transporting unit 103 may be configured to attract the print medium 2 with electrostatic force. Alternatively, the print medium 2 may be kept in contact with the protection belt 21 not to separate therefrom by the adhesiveness of the adhesive surface 2*b* of the print medium 2.

The sheet discharging unit 104 includes a receiving member 30, a cutter unit 31, and a discharge roller 32. The receiving member 30 guides the print medium 2 sent thereto from between the protection belt 21 and a later-described spur roller group 28*b* of the second medium holding device 108. The cutter unit 31 disposed downstream of the receiving member 30 in the medium transporting direction serves as a cutting device that cuts the print medium 2 into print medium pieces, i.e., label pieces 200 of a desired length. The cutter unit 31 includes an upper cutter 313 and a lower cutter formed by a downstream end surface of the receiving member 30 receiving the print medium 2. The upper cutter 313 moves in a direction substantially perpendicular to the medium transporting direction to cut the print medium 2 in conjunction with the lower cutter.

The discharge roller 32 is disposed downstream of the cutter unit 31 in the medium transporting direction to face a later-described spur roller group 33 of the second medium holding device 108. The discharge roller 32 and the spur roller group 33 hold the label piece 200 cut by the cutter unit 31, with a leading end portion of the label piece 200 discharged to the discharge opening 105 of the apparatus body 100. In the present embodiment, the outer circumferential surface of the discharge roller 32 for holding the label piece 200 is treated, for example, with an anti-adhesive for preventing the adhesive surface 2*b* of the label piece 200 from adhering to the surface of the discharge roller 32, to thereby make the adhesive surface 2*b* of the label piece 200 separable from the surface of the discharge roller 32. In this case, the discharge roller 32 as a whole may be made of a material separable from the adhesive surface 2*b*.

In the present embodiment, the guiding device 106 is constructed of the facing roller 24, a second roller 42, a third roller 43, an endless guide belt 44, a holder 45, and a shaft 46. The facing roller 24, which serves as a component of the transporting unit 103, as described above, also serves as a component of the guiding device 106. The second roller 42 serving as a separation roller is disposed downstream of the facing roller 24 serving as a first roller and upstream of the image forming unit 102 in the medium transporting direction. The third roller 43 is disposed on the opposite side of the second roller 42 across the facing roller 24. The guide belt 44 is stretched around the facing roller 24, the second roller 42, and the third roller 43. In the present embodiment, the guide belt 44 is a belt member including a base material made of polyimide and an outer circumferential surface formed with a release layer (e.g., a silicone coating layer) on the base material to improve the releasability of the guide belt 44 from the adhesive surface 2*b* of the print medium 2.

The facing roller 24, the second roller 42, and the third roller 43 are rotatably held by the holder 45. The holder 45 is disposed to be rotatable about the shaft 46 to allow the facing roller 24 to move between a position at which the facing roller 24 faces the transport roller 22 and a position at which the facing roller 24 is separated from the transport roller 22 to open the space between the facing roller 24 and the transport roller 22. The facing roller 24 is pressed toward the transport roller 22 by a pressing device such as a spring. Similarly, the second roller 42 is pressed toward the protection belt 21 by a pressing device such as a spring.

As described above, the present embodiment is configured to perform image formation on the print medium 2 with the adhesive surface 2*b* facing the protection belt 21. Alternatively, the image formation may be performed on the adhesive surface 2*b* of the print medium 2. In this case, it is preferable that the outer circumferential surface of the guide belt 44 is treated with an anti-adhesive for preventing the adhesive surface 2*b* of the print medium 2 from adhering to the surface of the guide belt 44.

In the present embodiment, the guiding device 106 serves as a first medium holding device disposed upstream of the image forming unit 102 in the medium transporting direction. Strictly speaking, the facing roller 24, the second roller 42, and the guide belt 44 hold the print medium 2. If the guiding device 106 does not include the guide belt 44, the facing roller 24 serves as the first medium holding device.

Figure 5:
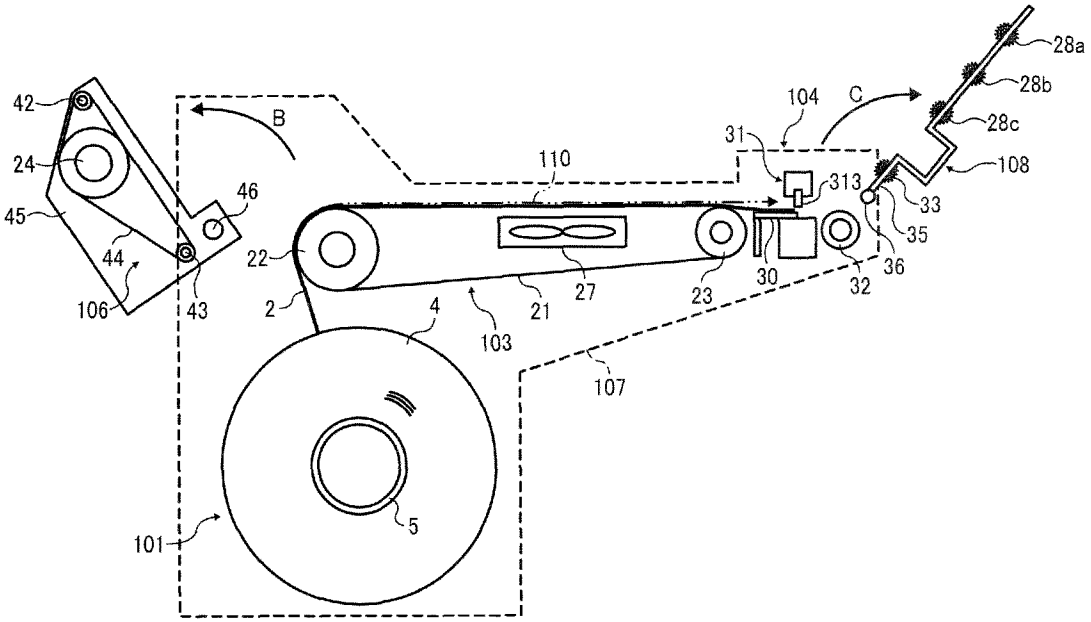
FIG. 5 is a front view of the sheet feeding and transporting unit with first and second medium holding devices rotated to open a transport path.

As described above, in the guiding device 106 serving as the first medium holding device, the holder 45 is held to be rotatable about the shaft 46. In the medium transporting direction, therefore, a downstream portion of the guiding device 106 is rotatable about an upstream portion of the guiding device 106 in a direction of separating from the transport path 110 extending from the transporting unit 103 to the sheet discharging unit 104 to retract to an open position for opening the transport path 110, as illustrated in FIG. 5.

The second medium holding device 108 disposed downstream of the image forming unit 102 in the medium transporting direction includes a spur holder 35, a shaft 36, and spur roller groups 28*a*, 28*b*, 28*c*, and 33 held by the spur holder 35. The spur roller groups 28*a*, 28*b*, and 28*c* are disposed near the driven roller 23 of the transporting unit 103, and the spur roller group 33 is disposed facing the discharge roller 32 of the sheet discharging unit 104. Each of the spur roller groups 28*a*, 28*b*, 28*c*, and 33 includes a plurality of spur rollers aligned in a direction substantially perpendicular to the medium transporting direction. The spur roller groups 28*a* and 28*b* located on the upstream side in the medium transporting direction face the protection belt 21, and the spur roller group 28*c* located downstream thereof in the medium transporting direction faces the receiving member 30 of the sheet discharging unit 104. The spur roller groups 28*a*, 28*b*, 28*c*, and 33 are integrally held by the spur holder 35, which also serves as a guide member for guiding the print medium 2. The spur holder 35 is rotatable about the shaft 36 to allow the spur roller groups 28*a*, 28*b*, 28*c*, and 33 to separate from the protection belt 21 and the discharge roller 32, as illustrated in FIG. 5.

In the second medium holding device 108, the spur holder 35 is held to be rotatable about the shaft 36, as described above. In the medium transporting direction, therefore, an upstream portion of the second medium holding device 108 is rotatable about a downstream portion of the second medium holding device 108 in a direction of separating from the transport path 110 extending from the transporting unit 103 to the sheet discharging unit 104 to retract to an open position for opening the transport path 110.

In the thus-configured image forming apparatus, the protection belt 21 and the print medium 2 unwound from the roll 4 installed in the sheet feeding unit 101 are set on the transport path 110 extending from the transporting unit 103 to the sheet discharging unit 104. Then, the transport roller 22 is driven to rotate to transport the print medium 2 with the adhesive surface 2*b* protected by the protection belt 21, and a desired image is formed on the print medium 2 by the recording heads 11 of the image forming unit 102. The print medium 2 having the image formed thereon is then separated from the protection belt 21 and sent to the sheet discharging unit 104 to be cut into the label piece 200 at a predetermined position by the cutter unit 31. Thereby, the label piece 200 is held between the discharge roller 32 and the spur roller group 33 to be dischargeable from the discharge opening 105 of the apparatus body 100.

Particularly in a case in which the image is formed on the adhesive surface 2*b* of the print medium 2, the guiding device 106 guides the print medium 2 during the transport or rewinding thereof to prevent the print medium 2 from being caught in the facing roller 24. Without the guide belt 44, the adhesive surface 2*b* of the print medium 2 may stick to and be caught in the outer circumferential surface of the facing roller 24 due to a relatively small curvature of the facing roller 24, even if the outer circumferential surface of the facing roller 24 is treated with an anti-adhesive. In this case, the curvature of the facing roller 24 may be increased to prevent such a transport failure. The increase in curvature of the facing roller 24, however, reduces the area of a clamp region between the facing roller 24 and the transport roller 22, making it difficult to obtain stable transport performance.

In the present embodiment, therefore, the print medium 2 in the medium transporting operation is transported while being held by the guide belt 44, and is reliably separated from the guide belt 44 by the second roller 42 with a relatively large curvature serving as a separation roller. Thereby, the print medium 2 is prevented from being caught in the facing roller 24 in the medium transporting operation. Also in the rewinding of the print medium 2, the guide belt 44 receives the adhesive surface 2*b* of the print medium 2 to prevent the print medium 2 from being caught in the facing roller 24.

After the image formation and the cutting of the print medium 2 by the cutter unit 31, a leading end portion of the print medium 2 is located at the position of the cutter unit 31. If the next image forming operation starts in this state, a portion of the print medium 2 facing the image forming unit 102 will be wasted without being used (i.e., with no image formed thereon). To prevent this, the print medium 2 is rewound in a rewinding direction opposite to the medium transporting direction to a position at which the leading end portion of the print medium 2 is located before (i.e., upstream of) the image forming unit 102 in the medium transporting direction.

In the present image forming apparatus, the sheet feeding unit 101, the transporting unit 103, the sheet discharging unit 104, the guiding device 106, and the second medium holding device 108 are integrated as the sheet feeding and transporting unit 107 drawably installed in the apparatus body 100. With the sheet feeding and transporting unit 107 thus configured to be integrally drawable from the apparatus body 100, the guiding device 106 serving as the first medium holding device and the second medium holding device 108 will not interfere with the image forming unit 102 and other components of the apparatus body 100, when rotated. Further, this configuration allows the entire space on the transport path 110 extending from the transporting unit 103 to the sheet discharging unit 104 to be opened, simplifying the operation of setting the print medium 2 (hereinafter referred to as the medium setting operation). Further, the sheet feeding unit 101 and the transporting unit 103 are integrated in one unit. When the sheet feeding and transporting unit 107 is pushed back to an image forming position inside the apparatus body 100 after the medium setting operation, therefore, the set print medium 2 will not be misaligned or skewed. Accordingly, the image formation is performed with the setting of the print medium 2 kept intact.

With reference to FIGS. 4 and 5, the configuration of the present embodiment for the medium setting operation will now be described. FIG. 4 is a perspective view of the sheet feeding and transporting unit 107 drawn from the apparatus body 100. FIG. 5 is a front view of the sheet feeding and transporting unit 107 with the guiding device 106 (i.e., the first medium holding device) and the second medium holding device 108 rotated to open the transport path 110.

As described above, the print medium 2 is wound in the roll 4 with no release liner attached to the adhesive surface 2*b*. The setting of the print medium 2 onto the protection belt 21, therefore, involves the peeling of the adhesive surface 2*b* from the roll 4 to unwind the print belt 21 from the roll 4. Further, when the print medium 2 unwound from the roll 4 is set onto the protection belt 21 by being fed between the facing roller 24 and the transport roller 22, care is exercised to prevent the adhesive surface 2*b* from sticking to other components. Moreover, if a skew or crease is caused in the print medium 2 when the adhesive surface 2*b* of the print medium 2 is separably placed onto the protection belt 21, stable transport performance is prevented. The setting of the print medium 2 with the exposed adhesive surface 2*b* is thus difficult compared with the setting of a normal rolled sheet. It is therefore desirable to improve the operability of the operation of setting the print medium 2.

As described above, therefore, the present embodiment is configured such that the sheet feeding unit 101, the transporting unit 103, the sheet discharging unit 104, the guiding device 106, and the second medium holding device 108 are integrated as the sheet feeding and transporting unit 107 drawably installed in the apparatus body 100, as illustrated in FIGS. 1 and 4. In FIG. 4, the illustration of the second medium holding device 108 is omitted. The operation panel 109 is provided on the front side of the apparatus body 100. The sheet feeding and transporting unit 107 is drawn toward the front side of the apparatus body 100 in a direction substantially perpendicular to the medium transporting direction. In the present embodiment, the sheet feeding unit 101 is disposed below the protection belt 21 of the transporting unit 103. Thus, the roll 4 is installed in the sheet feeding unit 101 in a direction parallel to the medium transporting direction. With the sheet feeding unit 101 thus disposed below the protection belt 21, the apparatus size in the medium transporting direction (i.e., the apparatus length in the lateral direction in FIG. 1) is reduced.

In such a configuration of the sheet feeding unit 101, it is difficult to install and remove the roll 4 from above, and the setting of the print medium 2 unwound from the roll 4 onto the transporting unit 103 is performed only from above, unless the space between an area for installing and removing the roll 4 (i.e., an area on the left side of the roll 4 in FIG. 1) and an area on the transporting unit 103 is open. In other words, to improve the operability of the medium setting operation, it is desirable to open the space between the area for installing and removing the roll 4 and the area on the transporting unit 103. In the present embodiment, therefore, the sheet feeding and transporting unit 107 is first drawn from the apparatus body 100 to perform the initial installation or replacement of the roll 4 into the sheet feeding unit 101 and the setting of the print medium 2 onto the protection belt 21. In this step, the sheet feeding and transporting unit 107 is drawn to a position allowing the roll 4 to be installed in the sheet feeding unit 101 in the medium transporting direction. Thereby, the medium setting operation is performed with improved visibility, without interference from other components such as a cover.

Figure 6:
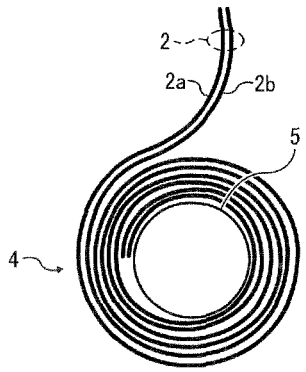
FIG. 6 is a diagram illustrating curling of the print medium caused by peeling of the print medium off a roll.

Since the print medium 2 being a linerless label sheet with no release liner attached to the adhesive surface 2*b* is wound in the roll 4, the adhesive surface 2*b* is peeled off from the roll 4 to rewind the print medium 2 from the roll 4. As a result, the peeled print medium 2 has a relatively large curl in a direction opposite to the winding direction of the roll 4, as illustrated in FIG. 6. To suppress the separation of the leading end portion of the print medium 2 from the protection belt 21 of the transporting unit 103 due to the curl of the print medium 2, therefore, the present embodiment is configured to include the guiding device 106 serving as the first medium holding device and the second medium holding device 108. Specifically, the guiding device 106 serving as the first medium holding device is disposed upstream of the image forming unit 102 in the medium transporting direction, and the second medium holding device 108 is disposed downstream of the image forming unit 102 in the medium transporting direction, to thereby hold the print medium 2 on the protection belt 21 and prevent the print medium 2 from separating therefrom during the medium setting operation. This configuration prevents the print medium 2 from coming into contact with the image forming unit 102 owing to the leading end portion of the print medium 2 separated from the protection belt 21. Accordingly, the medium setting operation is stably performed.

Each of the guiding device 106 serving as the first medium holding device and the second medium holding device 108 is retractable to the open position for opening the transport path 110. As illustrated in FIG. 5, therefore, the guiding device 106 is rotated in the direction of arrow B, and the second medium holding device 108 is rotated in the direction of arrow C before the print medium 2 unwound from the roll 4 is set onto the protection belt 21. Thereby, the guiding device 106 and the second medium holding device 108 are moved to the respective open positions to open the transport path 110.

Thereafter, the roll 4 is installed in the sheet feeding unit 101, and the print medium 2 is peeled and unwound from the roll 4. Then, the leading end portion of the print medium 2 is passed between the facing roller 24 of the guiding device 106 and the transport roller 22 and brought to a position upstream of the cutter unit 31 in the medium transporting direction, and the print medium 2 is set on the protection belt 21. Since this step involves peeling and unwinding of the print medium 2 from the roll 4, the leading end portion of the print medium 2 is touched by, for example, fingers of a user, and oil of the fingers is transferred to the adhesive surface 2*b* of the print medium 2, reducing the adhesive force of the adhesive surface 2*b*. Therefore, the print medium 2 is set with the leading end portion thereof brought to a position downstream of the image forming unit 102 in the medium transporting direction, to thereby prevent the use of the leading end portion reduced in adhesive force and a resultant adhesion failure of the label piece 200. The leading end portion with the reduced adhesive force may be cut off by the cutter unit 31.

Thereafter, the guiding device 106 serving as the first medium holding device and the second medium holding device 108 are moved to respective positions for holding the print medium 2 on the transport path 110, as illustrated in FIG. 2. Then, the sheet feeding and transporting unit 107 is pushed into the apparatus body 100. Thereby, the medium setting operation is completed. During this operation, the relative positions of the roll 4 in the sheet feeding unit 101 and the protection belt 21 in the transporting unit 103 are unchanged. Thus, the sheet feeding and transporting unit 107 is installed in the apparatus body 100 with the print medium 2 set on the protection belt 21 without being misaligned or skewed. Consequently, the print medium 2 is stably transported.

As described above, the present image forming apparatus is configured to include the guiding device 106 serving as the first medium holding device and the second medium holding device 108, which hold the print medium 2 on the transport path 110. The guiding device 106 is disposed upstream of the image forming unit 102 in the medium transporting direction, and the second medium holding device 108 is disposed downstream of the image forming unit 102 in the medium transporting direction. Further, the guiding device 106 and the second medium holding device 108 are configured to be retractable to the respective open positions for opening the transport path 110. With this configuration, the operability of the operation of setting the rolled print medium 2 is improved.

For example, in a configuration not allowing the second medium holding device 108 to retract to the open position, it is difficult to perform the medium setting operation by passing the printing medium 2 under the second medium holding device 108. In such a configuration, therefore, the leading end portion of the print medium 2 is set at a position upstream of the second medium holding device 108 in the medium transporting direction. If the print medium 2 is set in such a manner, however, the print medium 2 may come into contact with the image forming unit 102 and/or the second medium holding device 108 owing to the curled leading end portion separated from the protection belt 21, and cause a transport jam, for example. To hold the leading end portion of the print medium 2 while preventing such a failure, the print medium 2 may be set with the leading end portion thereof placed under the guiding device 106 serving as the first medium holding device. In that case, however, it is difficult to visually check whether or not the print medium 2 is set at the correct position.

Meanwhile, the present embodiment allows the second medium holding device 108 on the downstream side in the medium transporting direction to be opened, making it possible to stretch the print medium 2 to the end of the transport path 110 in the medium setting operation. The present configuration therefore prevents transport jams caused by the separation of the curled leading end portion of the print medium 2 from the protection belt 21, making it possible to perform the medium setting operation while visually checking the accuracy of the setting position.

Further, the guiding device 106 serving as the first medium holding device and the second medium holding device 108 are configured to rotate in mutually opposite directions along the medium transporting direction to open the transport path 110, as illustrated in FIG. 5. This configuration allows the entire transport path 110 to be opened, further improving the operability of the medium setting operation.

Figure 7:
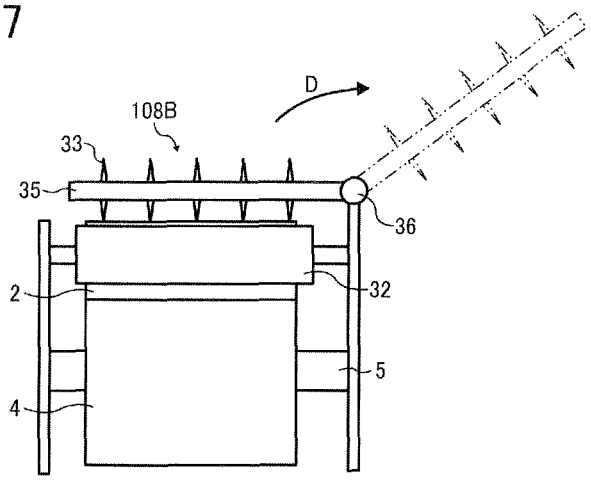
FIG. 7 is a side view of a second medium holding device according to a second embodiment of the present invention, as viewed from the side of a sheet discharging unit of the mechanical section along a medium transporting direction.

With reference to FIG. 7, a second embodiment of the present invention will now be described.

FIG. 7 is a side view of a second medium holding device 108B according to the second embodiment, as viewed from the side of the sheet discharging unit 104 (i.e., from the right side of the apparatus body 100 in FIG. 1) along the medium transporting direction. In the second medium holding device 108B of the second embodiment located on the downstream side in the medium transporting direction, the shaft 36 of the spur holder 35 is disposed to extend along the medium transporting direction. The shaft 36 is provided to one end portion of the spur holder 35 in a direction substantially perpendicular to the medium transporting direction. The other end portion of the spur shaft 35 is rotatable about the shaft 36 at the one end portion of the spur shaft 35 in the direction of arrow D, i.e., a direction of separating from the transport path 110. The guiding device 106 serving as the first medium holding device may be configured similarly to the second medium holding device 108B such that, in the direction substantially perpendicular to the medium transporting direction, one end portion of the guiding device 106 is rotatable about the other end portion of the guiding device 106 in a direction of separating from the transport path 110. Further, the configuration of the second embodiment may be combined with the configuration of the first embodiment. The thus-configured second embodiment also allows the transport path 110 to be opened, providing similar operations and effects to those of the first embodiment. Further, the second embodiment reduces the space in the width direction (i.e., the lateral direction in FIG. 1) used for the medium setting operation.

Figure 8:
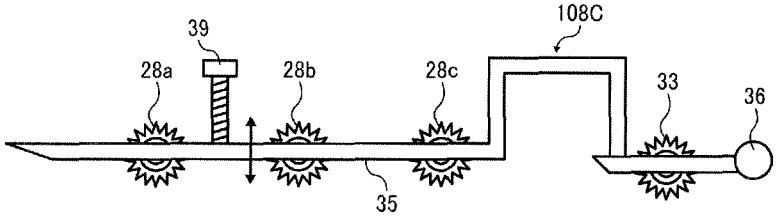
FIG. 8 is a front view of a second medium holding device according to a third embodiment of the present invention.

With reference to FIG. 8, a third embodiment of the present invention will now be described.

FIG. 8 is a front view of a second medium holding device 108C according to the third embodiment. The third embodiment includes an adjuster 39 (i.e., pressure adjustment mechanism) that adjusts the pressure of the spur roller groups 28*a*, 28*b*, 28*c*, and 33 by allowing the spur holder 35 of the second medium holding device 108C to move up and down (i.e., move toward and away from the transport path 110). With this configuration, the pressure with which the second medium holding device 108C holds the print medium 2 is adjusted. Since different types of print media have different thicknesses and/or different resilience levels, the necessary pressure changes in accordance with the type of the print medium 2. For example, inappropriately excessive pressure applied to the print medium 2 results in an increase in load in the medium transporting operation, and may cause a transport jam or degradation of the image quality such as spur marks on a surface of the printed image. The third embodiment capable of adjusting the pressure prevents print failure due to excessive pressure from occurring with various types of print media. The guiding device 106 serving as the first medium holding device may also include an adjuster similar to the adjuster 39 of the second medium holding device 108C to adjust the pressure to be applied to the print medium 2 by the guiding device 106.

According to the above-described embodiments of the prevent invention, the operability of the operation of setting a rolled print medium is improved.

The above-described embodiments use the linerless label sheet with no release liner. The present invention, however, is similarly applicable to a rolled print medium with a curl having an adhesive surface with a release liner and a rolled sheet with no adhesive surface, for example. In the present specification, the term "image formation" refers to providing a medium with a meaningful image such as a character or a figure and also providing a medium with a meaningless image such as a pattern (i.e., simple ejection of liquid droplets onto a medium). Further, the term "ink" is not limited to so-called ink, and is used to collectively refer to various types of liquids with which the image formation is performed, such as recording liquid and fixing liquid. Further, the image forming apparatus includes both a serial-type image forming apparatus and a line-type image forming apparatus.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus comprising:

a roll holding device to hold a roll of recording medium;

an image forming device configured to form an image on a print medium unwound, and as a continuum, from the roll of recording medium held by the roll holding device;

a transporting device configured to transport the unwound print medium in a medium transporting direction and to transport the print medium along a transport path facing the image forming device;

a first medium holding device separated from the image forming device, and disposed upstream of the image forming device in the medium transporting direction, and configured to hold the print medium on the transport path and to rotate in a first rotation direction to retract to an open position for opening the transport path to view and access the print medium as a continuum from the roll of recording medium held by the roll holding device; and a second medium holding device separated from the image forming device, and disposed downstream of the image forming device in the medium transporting direction in which the print medium having the image formed thereon by the image forming device is transported, and configured to hold the print medium on the transport path and to rotate in a second rotation direction different from the first rotation direction, to retract to an open position for opening the transport path.

2. The image forming apparatus according to claim 1, wherein the print medium includes a printing surface and an adhesive surface with no release liner attached thereto.

3. The image forming apparatus according to claim 1, wherein, in the medium transporting direction, a downstream portion of the first medium holding device is rotatable about an upstream portion of the first medium holding device in a direction of separating from the transport path.

4. The image forming apparatus according to claim 1, wherein, in the medium transporting direction, an upstream portion of the second medium holding device is rotatable about a downstream portion of the second medium holding device in a direction of separating from the transport path.

5. The image forming apparatus according to claim 1, wherein, in a direction substantially perpendicular to the medium transporting direction, one end portion of the first medium holding device is rotatable about another end portion of the first medium holding device in a direction of separating from the transport path.

6. The image forming apparatus according to claim 1, wherein, in a direction substantially perpendicular to the medium transporting direction, one end portion of the second medium holding device is rotatable about another end portion of the second medium holding device in a direction of separating from the transport path.

7. The image forming apparatus according to claim 1, further comprising a pressure adjustment mechanism disposed in at least one of the first medium holding device and the second medium holding device and configured to adjust pressure applied to the print medium by at least one of the first medium holding device and the second medium holding device.

8. The image forming apparatus according to claim 1, wherein the transporting device is disposed below the image forming device and includes a transport roller, and the first medium holding device comprises a facing roller, the transport roller of the transporting device and the facing roller of the first medium holding device forming a transport roller pair to clamp and transport the print medium, and wherein the facing roller retracts along with the first medium holding device to the open position for opening the transport path, while the transport roller and the transporting device remain unmoved in place.

9. The image forming apparatus according to claim 1, wherein the first medium holding device comprises a guide belt to guide the print medium to the image forming device while pressing the print medium between the guide belt and the transport device, and the guide belt retracts along with the first medium holding device to the open position for opening the transport path.

10. An image forming apparatus comprising:

a roll holding device to hold a roll of recording medium;

an image forming device configured to form an image on a print medium unwound, and as a continuum, from the roll of recording medium held by the roll holding device;

a transporting device configured to transport the unwound print medium along a transport path facing the image forming device;

a first medium holding device disposed upstream of the image forming device in a medium transporting direction, and configured to hold the print medium on the transport path and retract to an open position for opening the transport path to view and access the print medium as a continuum from the roll of recording medium held by the roll holding device; and a second medium holding device disposed downstream of the image forming device in the medium transporting direction, and configured to hold the print medium on the transport path and retract to an open position for opening the transport path, wherein the first medium holding device comprises a guide belt to guide the print medium to the image forming device while pressing the print medium between the guide belt and the transport device, and the guide belt retracts along with the first medium holding device to the open position for opening the transport path.

11. An image forming apparatus comprising:

an image forming device configured to form an image on a print medium unwound from a roll;

a transporting device configured to transport the unwound print medium in a medium transporting direction and to transport the print medium along a horizontal transport path facing the image forming device;

a first medium holding device separated from the image forming device, and disposed upstream of the image forming device in the medium transporting direction, and configured to hold the print medium on the transport path and to rotate in a first rotation direction to retract to an open position for opening the transport path; and a second medium holding device separated from the image forming device, and disposed downstream of the image forming device in the medium transporting direction in which the print medium having the image formed thereon by the image forming device is transported, and configured to hold the print medium on the transport path and to rotate in a second rotation direction, different from the first rotation direction, to retract to an open position for opening the transport path, wherein each of the first medium holding device and the second medium holding device are positioned above the horizontal transport path, in order to retract to the respective open positions for accessing the transport path from above.

12. The image forming apparatus according to claim 11, wherein the first medium holding device comprises a guide belt to guide the print medium to the image forming device while pressing the print medium between the guide belt and the transport device, and the guide belt retracts along with the first medium holding device to the open position for opening the transport path.

* * * * *